US009697960B2

(12) United States Patent
Tsukimori et al.

(10) Patent No.: US 9,697,960 B2
(45) Date of Patent: Jul. 4, 2017

(54) SWITCH

(71) Applicant: OMRON Corporation, Kyoto-shi, Kyoto (JP)

(72) Inventors: Kazuyuki Tsukimori, Okayama (JP); Manabu Takahashi, Okayama (JP); Hiroyuki Moriyama, Tottori (JP); Shinya Katsube, Okayama (JP); Yuki Yamamoto, Okayama (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 14/497,041

(22) Filed: Sep. 25, 2014

(65) Prior Publication Data

US 2015/0114805 A1 Apr. 30, 2015

(30) Foreign Application Priority Data

Oct. 24, 2013 (JP) ..... 2013-221464

(51) Int. Cl.
*H01H 3/16* (2006.01)
*H01H 3/18* (2006.01)
(Continued)

(52) U.S. Cl.
CPC ..... *H01H 3/42* (2013.01); *H01H 3/16* (2013.01); *H01H 21/285* (2013.01); *H01H 2235/01* (2013.01)

(58) Field of Classification Search
CPC H01H 3/16; H01H 3/18; H01H 15/14; H01H 17/12; H01H 19/18; H01H 21/28;
(Continued)

(56) References Cited

U.S. PATENT DOCUMENTS 2,289,643 A 3/1942 Furnas et al.
3,270,578 A * 9/1966 Leadbeater ..... F16H 55/56 474/21
(Continued)

FOREIGN PATENT DOCUMENTS

DE 19902910 A1 8/2000
EP 0483825 A2 5/1992
(Continued)

OTHER PUBLICATIONS

LS series (general-purpose compact limit switches) available from Azbil Corporation,URL:<http://www.compoclub.com/support/selectionguide/scc/CP-GC1003/D/LS_1003.pdf?download>(searched on Oct. 21, 2013).
(Continued)

*Primary Examiner* — Anthony R. Jimenez
(74) *Attorney, Agent, or Firm* — Osha Liang LLP

(57) ABSTRACT

A switch has a rotary shaft that rotates in response to an external force, a cam provided on the rotary shaft and including a cam action section, wherein the cam rotates in response to the rotation of the rotary shaft, a displacement member including a cam support section that contacts the cam action section, wherein the displacement member is displaced in response to the cam support section being pressed by the cam action section rotating, and a switch module that performs an on-off action in response to the displacement of the displacement member. The cam action section is made of a metal. The cam support section is made of a resin softer than the cam action section.

5 Claims, 9 Drawing Sheets

(51) Int. Cl.

| | |
|---|---|
| ***H01H 15/14*** | (2006.01) |
| ***H01H 17/12*** | (2006.01) |
| ***H01H 19/18*** | (2006.01) |
| ***H01H 21/28*** | (2006.01) |
| ***H01H 3/42*** | (2006.01) |

(58) Field of Classification Search

CPC H01H 1/023; H01H 1/14; H01H 3/00; H01H 3/02; H01H 3/04; H01H 3/08; H01H 3/32; H01H 19/00; H01H 19/02; H01H 19/14; H01H 19/20; H01H 19/28; H01H 19/36; H01H 19/54; H01H 19/62; H01H 19/63; H01H 19/635; H01H 2003/08; H01H 2003/32; H01H 2003/46; H01H 2003/0088; H01H 2221/024; H01H 2221/026; H01H 2221/028; H01H 2221/03

USPC ..... 200/47

See application file for complete search history.

(56) References Cited

U.S. PATENT DOCUMENTS

| | | | | |
|---|---|---|---|---|
| 3,740,504 | A | 6/1973 | Hipple | |
| 5,207,316 | A * | 5/1993 | Sakamoto | H01H 11/0006 200/47 |
| 8,653,178 | B2 * | 2/2014 | Hon | B29C 47/0014 523/214 |
| 2006/0111249 | A1 * | 5/2006 | Shinohara | C08K 9/04 508/107 |
| 2011/0270256 | A1 * | 11/2011 | Nelson | A61B 17/1624 606/85 |
| 2014/0326586 | A1 | 11/2014 | Tsukimori et al. | |
| 2014/0360849 | A1 | 12/2014 | Takahashi et al. | |

FOREIGN PATENT DOCUMENTS

| | | | |
|---|---|---|---|
| EP | 2804192 | A1 | 11/2014 |
| EP | 2804193 | A1 | 11/2014 |
| JP | 2013-145674 | A | 7/2013 |
| JP | 2013-145675 | A | 7/2013 |

OTHER PUBLICATIONS

Partial European Search Report issued in corresponding European Application No. 14186147.6, mailed on Mar. 26, 2015 (5 pages).

Extended European Search Report issued in corresponding European Application No. 14186147.6, mailed on Jul. 29, 2015 (10 pages).

* cited by examiner

SWITCH

CROSS-REFERENCE TO RELATED APPLICATIONS

This Nonprovisional application claims priority under 35 U.S.C. §119 on Patent Application No. 2013-221464 filed in Japan on Oct. 24, 2013, the entire contents of which are hereby incorporated by reference.

BACKGROUND

Technical Field

The present invention relates to a switch that, for example, is disposed on a production line at a factory to detect the arrival at a designated position of an object to be processed.

Related Art

Factories have been using a lot of limit switches for their production lines. Such limit switches are used to detect that an object to be processed has been conveyed to a predetermined position for processing and automatically activate a processing machine.

A known example of such limit switches is one arranged such that a rotary lever and a rotary shaft connected with the rotary lever are rotated by an external force, that that rotation drives a cam provided for the rotary shaft to push a plunger (displacement member) to displace it, and that the displacement of the plunger turns a switch module on and off, the cam and the plunger each being made of a metal material.

CITATION LIST

Non Patent Literature 1

LS series (general-purpose compact limit switches) available from Azbil Corporation, URL: <http://www.compo-club.com/support/selectionguide/scc/CP-GC1003/D/LS_1003.pdf?download> (searched on Oct. 21, 2013).

SUMMARY

In the above conventional arrangement, since the cam and the plunger are both made of a hard (metal) material, it is difficult to improve the durability.

Specifically, in the case where the cam and the plunger are both made of a hard (metal) material, the cam and the plunger wear out each other continuously as the limit switch is operated. This makes it difficult to allow the limit switch to have greater durability.

One or more embodiments of the present invention provides a switch with greater durability and higher reliability.

One or more embodiments of the present invention provides a switch including: a rotary shaft adapted to rotate in response to an external force; a cam provided on the rotary shaft and including a cam action section, the cam being adapted to rotate in response to the rotation of the rotary shaft; a displacement member including a cam support section adapted to contact the cam action section, the displacement member being adapted to be displaced in response to the cam support section being pressed by the cam action section rotating; and a switch module for performing an on-off action in response to the displacement of the displacement member, the cam action section being made of a metal, the cam support section being made of a resin softer than the cam action section.

With the above arrangement, in a case where the rotary shaft has been rotated by an external force, the cam is rotated in response to the rotation of the rotary shaft. The cam action section of the cam then presses the cam support section of the displacement member to displace the displacement member. This displacement of the displacement member drives the switch module to perform an on-off action.

If, for instance, the cam action section of the cam and the cam support section of the displacement member are each made of a hard metal, the cam action section and the cam support section will wear out each other continuously as the switch is used, likely decreasing the durability of the switch.

This is contrasted with the switch of one or more embodiments of the present invention, in which the cam action section is made of a metal, whereas the cam support section of the displacement member is made of a resin softer than the cam action section of the cam. With this arrangement, at the start of the use of the switch, the cam support section of the displacement member may be worn out easily. However, by the time the cam support section of the displacement member has been worn out to an extent, the cam action section and the cam support section will fit ideally with each other on the abutting surface, making the cam support section of the displacement member unlikely to wear out thereafter. This allows the switch to have greater durability and higher reliability.

One or more embodiments of the present invention allows the switch to have greater durability and higher reliability.

DETAILED DESCRIPTION

Embodiments of the present invention are described below with reference to the drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

<Overall Arrangement of Limit Switch 1>

Figure 1:
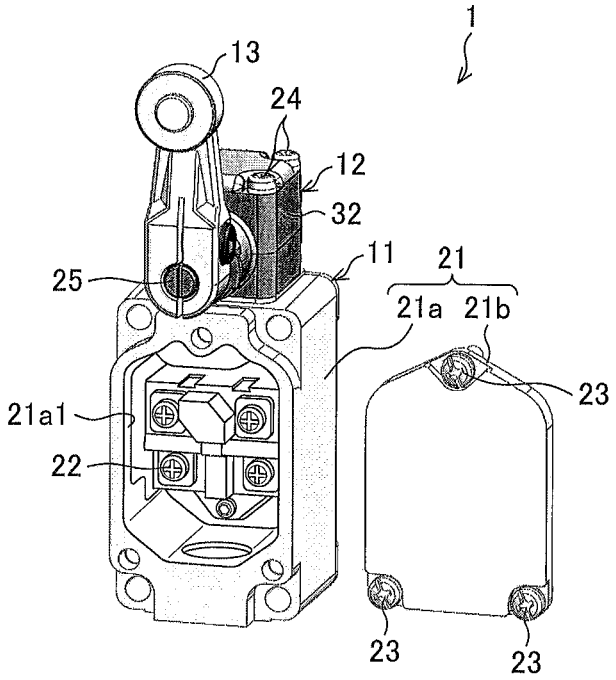
FIG. 1 is a perspective view of a limit switch of one or more embodiments of the present invention.

FIG. 1 is a perspective view of a limit switch (switch) 1 according to one or more embodiments of the present invention. The limit switch 1 detects, for example, the position or a change, movement, or passage of an object and performs an on-off action in correspondence with whether or not the limit switch 1 has detected it.

The limit switch 1, as illustrated in FIG. 1, includes a switch action section 11, a cam-containing block 12, and a rotary lever 13.

The switch action section 11 includes an action section housing 21 and a switch module 22. The action section housing 21 includes a housing main section 21*a* and a lid section 21*b*. The switch module 22 is disposed in a space inside the housing main section 21*a*. The lid section 21*b* is attached to the housing main section 21*a* with screws 23 in such a manner as to block the opening section 21*a*1 provided for the housing main section 21*a* to allow the switch module 22 to be embedded in the housing main section 21*a*.

The cam-containing block 12 is fixed to an upper portion of the switch action section 11 with screws 24. The rotary lever 13 is fixed to a rotary shaft 31 (see FIG. 2) of the cam-containing block 12 with a screw 25.

The rotary shaft 31 has a portion for attachment of the rotary lever 13, the portion projecting from a block housing 32 of the cam-containing block 12 in the horizontal direction. The rotary lever 13 is attached to that projection. The rotary lever 13, in its home position, extends upward from the rotary shaft 31. The home position of the rotary lever 13 refers to the position held by the rotary lever 13 when no external force is applied to the rotary lever 13 through contact with an object.

With the rotary lever 13 in the upright position illustrated in FIG. 1 (that is, when the limit switch 1 is viewed from the side of the rotary lever 13 in the direction in which the rotary shaft 31 extends), (i) applying an external force to the rotary lever 13 from the left drives it to rotate clockwise together with the rotary shaft 31, and then releasing the rotary lever 13 causes it to return to its home position, and (ii) applying an external force to the rotary lever 13 from the right drives it to rotate counterclockwise together with the rotary shaft 31, and then releasing the rotary lever 13 causes it to return to its home position.

The switch module 22 includes a photointerrupter and a mechanical or other type of switch. The switch module 22 performs an on-off action in response to the above rotation of the rotary lever 13.

<Arrangement of Cam-Containing Block 12>

Figure 2:
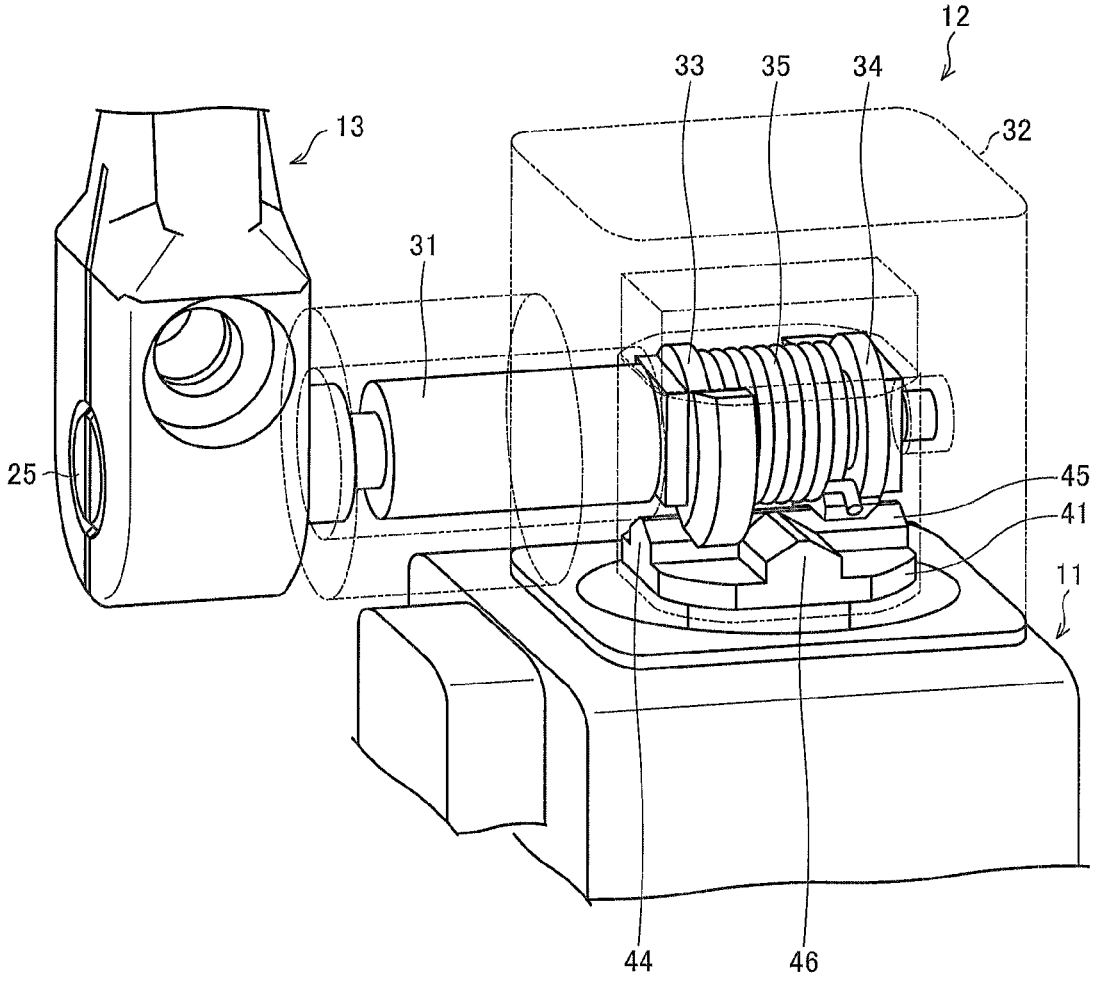
FIG. 2 is a perspective view of the cam-containing block of FIG. 1, the perspective view illustrating its structure.
Figure 3:
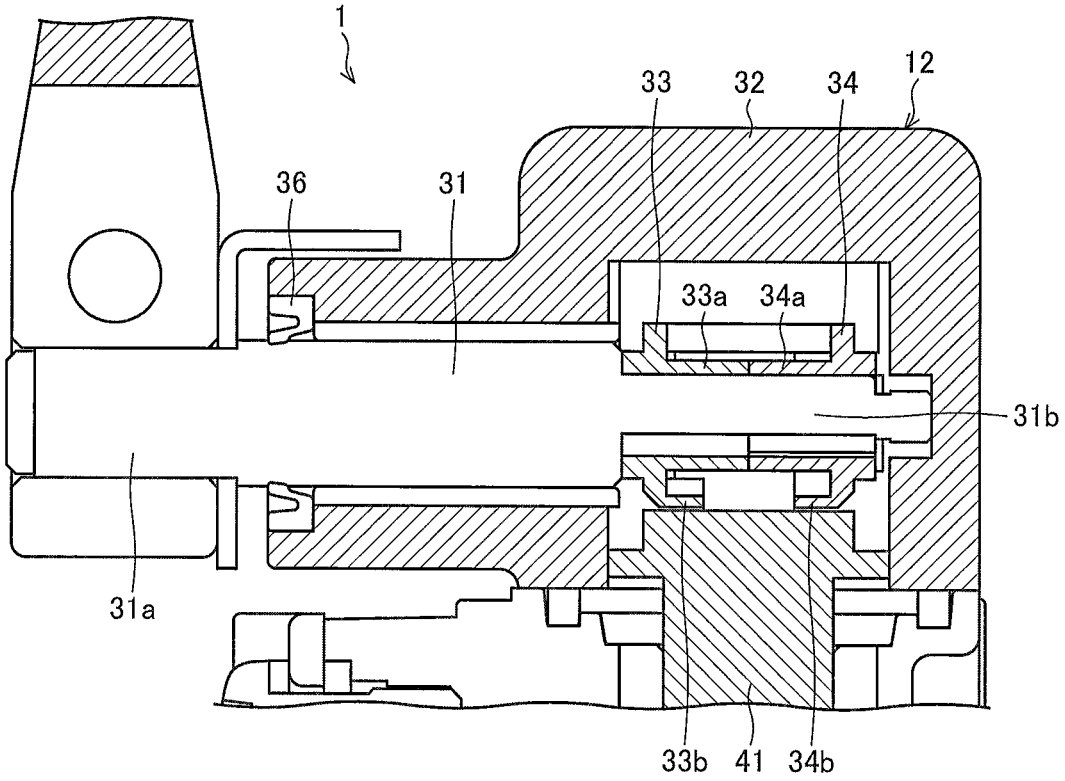
FIG. 3 is a longitudinal sectional view of the cam-containing block of FIG. 2.
Figure 4:
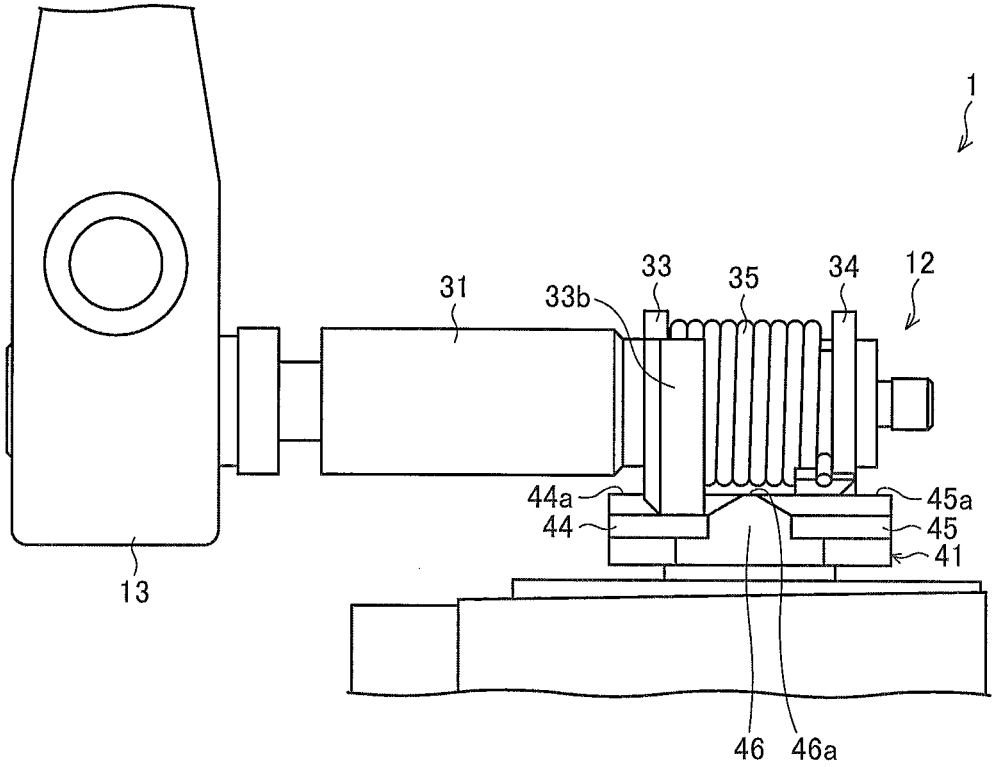
FIG. 4 is an elevational view of the limit switch, the elevational view illustrating a structure inside a block housing of the cam-containing block of FIG. 2.
Figure 5:
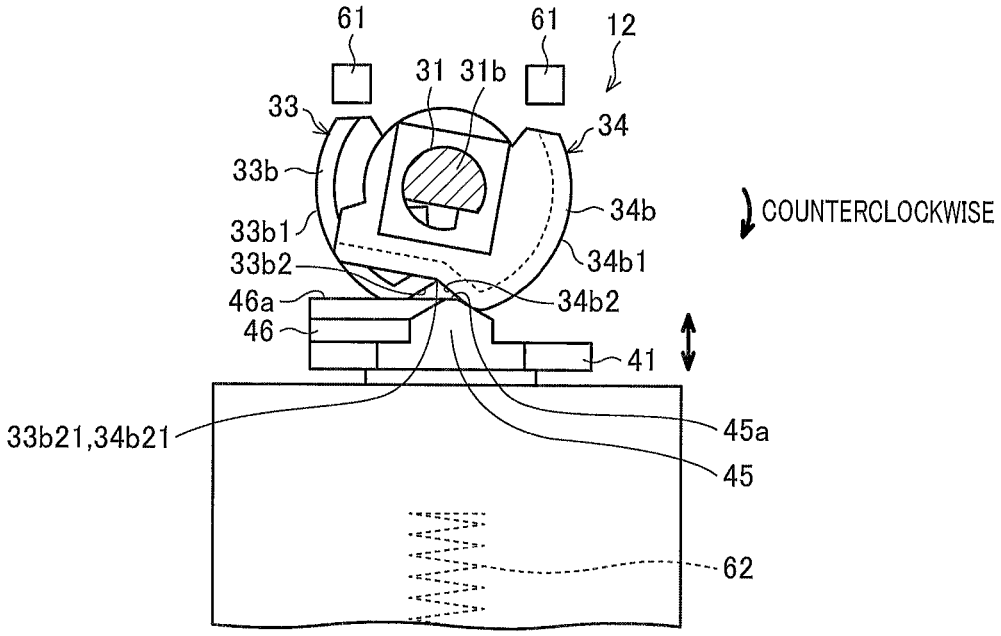
FIG. 5 is a side view of the cam-containing block of FIG. 4, the side view being taken from the side of a minor-diameter portion of a rotary shaft toward a major-diameter portion thereof.

FIG. 2 is a perspective view of the cam-containing block 12, the perspective view illustrating its structure. FIG. 3 is a longitudinal sectional view of the cam-containing block 12. FIG. 3 illustrates the cam-containing block 12 with a torsion spring 35 removed. FIG. 4 is an elevational view of the limit switch 1, the elevational view illustrating a structure inside the block housing 32 of the cam-containing block 12. FIG. 5 is a side view of the cam-containing block 12 illustrated in FIG. 4, the side view being taken from the side of a minor-diameter portion 31*b* of the rotary shaft 31 toward a major-diameter portion 31*a* thereof.

The cam-containing block 12, as illustrated in FIGS. 2 and 3, includes a rotary shaft 31, a block housing 32, a first cam 33, a second cam 34, and a torsion spring 35.

The rotary shaft 31 is supported rotatably by the block housing 32 by means of a bearing 36 (see FIG. 3) or the like. The rotary shaft 31 has (i) a major-diameter portion 31*a* to which the rotary lever 13 is attached and (ii) a minor-diameter portion 31*b* opposite from the major-diameter portion 31*a*.

(Arrangements of First Cam 33 and Second Cam 34)

The first cam 33 and the second cam 34 are each made of a metal material such as SMF5040. The first cam 33 and the second cam 34 are attached to the minor-diameter portion 31*b* of the rotary shaft 31, and are rotated as the rotary shaft 31 rotates. The first cam 33 and the second cam 34 are separated from each other by the torsion spring 35.

To be more specific, the first cam 33 and the second cam 34, as illustrated in FIG. 3, include shaft attachment sections 33*a* and 34*a* and cam action sections 33*b* and 34*b*, respectively. The shaft attachment sections 33*a* and 34*a* each have a tube shape and extend along the rotary shaft 31 in the direction in which the first cam 33 and the second cam 34 face each other. The torsion spring 35 is disposed around the shaft attachment sections 33*a* and 34*a*.

As illustrated in FIG. 5, the second cam 34 is fitted with the minor-diameter portion 31*b* of the rotary shaft 31 and is acted on by the force of the torsion spring 35 in such a manner that (i) a counterclockwise rotation of the rotary shaft 31 drives the second cam 34 to rotate together with the rotary shaft 31 because there is no play between the minor-diameter portion 31*b* and the second cam 34 and that (ii) a clockwise rotation of the rotary shaft 31 does not drive the second cam 34 to rotate together with the rotary shaft 31 because there is some play between the minor-diameter portion 31*b* and the second cam 34. To achieve such an arrangement, the cam-containing block 12 further includes a rotation limiting member 61 above the second cam 34.

The first cam 33 is fitted with the minor-diameter portion 31*b* of the rotary shaft 31 and is acted on by the force of the torsion spring 35 in such a manner that (i) a clockwise rotation of the rotary shaft 31 drives the first cam 33 to rotate together with the rotary shaft 31 because there is no play between the minor-diameter portion 31*b* and the first cam 33 and that (ii) a counterclockwise rotation of the rotary shaft 31 does not drive the first cam 33 to rotate together with the rotary shaft 31 because there is some play between the minor-diameter portion 31*b* and the first cam 33. To achieve such an arrangement, the cam-containing block 12 further includes a rotation limiting member 61 above the first cam 33 as for the second cam 34.

The cam action sections 33*b* and 34*b* are, as illustrated in FIG. 5, located at peripheral portions of plate-shaped portions of the first cam 33 and second cam 34 which plate-shaped portions extend in the direction perpendicular to the rotary shaft 31. The cam action sections 33*b* and 34*b* extend in the direction in which the first cam 33 and the second cam 34 face each other. The cam action sections 33*b* and 34*b* have respective widths (that is, the respective lengths along the rotary shaft 31) that are narrower than the respective widths of the shaft attachment sections 33*a* and 34*a* (that is, the respective lengths along the rotary shaft 31).

The cam action sections 33*b* and 34*b* include switch-on sections 33*b*1 and 34*b*1 and switch-off sections 33*b*2 and 34*b*2, respectively. The switch-on sections 33*b*1 and 34*b*1 are each in the shape of an arc of which the center coincides with the shaft center of the rotary shaft 31, and correspond to maximum-diameter portions of the first cam 33 and second cam 34. The switch-off sections 33*b*2 and 34*b*2 slope linearly from the switch-on sections 33*b*1 and 34*b*1 respectively in such a direction as to be closer to the rotary shaft 31 (that is, in such a direction that the cam action sections 33*b* and 34*b* each have a smaller diameter) to form depressions 33*b*21 and 34*b*21.

The cam action section 33*b* and the cam action section 34*b* are shaped in symmetry with each other with respect to a plane that is parallel to the rotary shaft 31 through its center. The torsion spring 35 has (i) on the side of the first cam 33 a first end engaged with an end of the switch-off section 33*b*2 included in the cam action section 33*b* of the first cam 33 and (ii) on the side of the second cam 34 a second end engaged with an end of the switch-off section 34*b*2 included in the cam action section 34*b* of the second cam 34.

<Arrangement of Switch Action Section 11>

Figure 6:
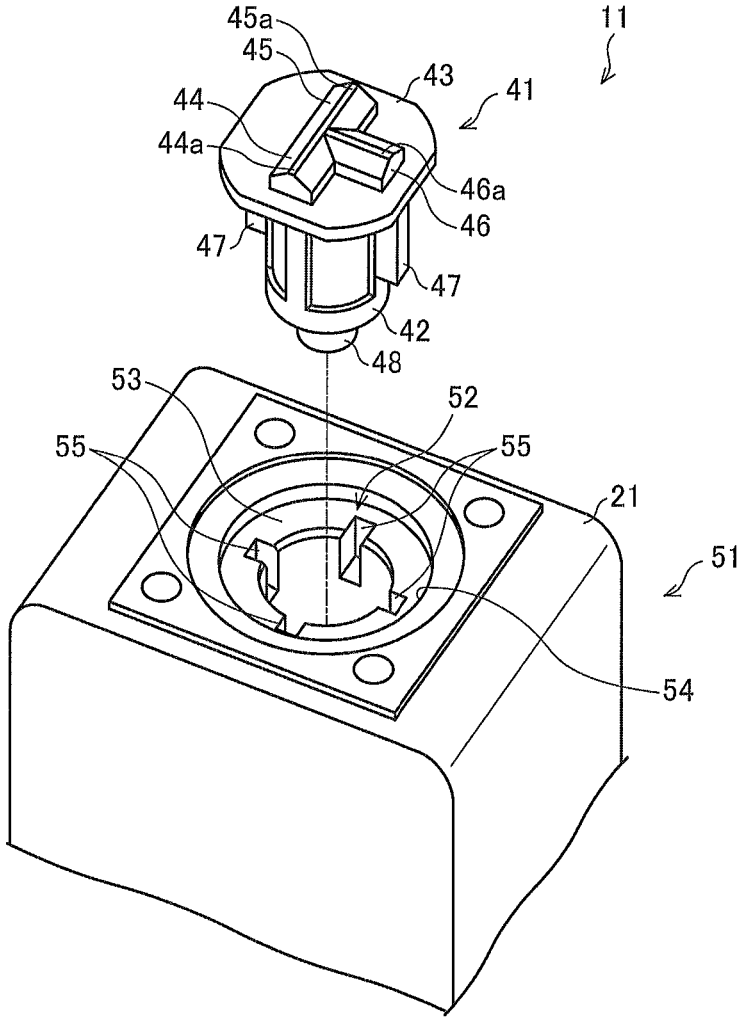
FIG. 6 is an exploded perspective view of the switch action section of FIG. 1, the exploded perspective view illustrating a plunger and a switch action main section.

The switch action section 11, as illustrated in FIG. 6, includes a plunger (displacement member) 41 and a switch action main section 51. FIG. 6 is an exploded perspective view of the switch action section 11, the exploded perspective view illustrating the plunger 41 and the switch action main section 51.

(Arrangement of Plunger 41)

The plunger 41 is made of a resin material. Examples of the resin material include polyamide (PA), polyacetal (POM), polyphenylene sulfide (PPS), liquid crystal polymer (PCP), and polyether ether ketone (PEEK). The resin material may be provided with any of various additives for improved performance: For instance, a glass filler may be added for increased hardness, or a fluorine resin for increased lubricity.

The plunger 41 has a barrel portion 42, a plate-shaped portion 43, and a rod-shaped portion 48. The plate-shaped portion 43 is located above the barrel portion 42 horizontally. The rod-shaped portion 48 projects from the bottom surface of the barrel portion 42 downward in the direction perpendicular to the bottom surface.

The plate-shaped portion 43 has a top surface provided with first to third cam support sections 44 to 46 in a T shape. The first and second cam support sections 44 and 45 are so located as to form a straight line together. The third cam support section 46 extends from the joint between the first and second cam support sections 44 and 45 orthogonally to the first and second cam support sections 44 and 45.

The first, second, and third cam support sections 44, 45, and 46 have, at upper portions thereof, triangular projections 44*a*, 45*a*, and 46*a* shaped in correspondence with the depression 33*b*21 (depression 34*b*21) of the switch-off section 33*b*2 (switch-off section 34*b*2) in the first cam 33 (second cam 34).

The barrel portion 42 of the plunger 41 is substantially cylindrical, and has a peripheral surface provided with two positioning protrusions 47 that extend in the axis direction (up-and-down direction) of the barrel portion 42. The two positioning protrusions 47 are so disposed as to be separated from each other by 180 degrees with the axis of the barrel portion 42 as the center. One of the positioning protrusions 47 is located at, for example, a position corresponding to the position of the third cam support section 46, that is, a position directly below the third cam support section 46.

(Arrangement of Switch Action Main Section 51)

The switch action main section 51 has, at an upper portion thereof, a plunger mounting recess section 52 in which the plunger 41 is mounted. The plunger mounting recess section 52 includes (i) a plate-shaped portion support section 53 on which the plate-shaped portion 43 of the plunger 41 is disposed and (ii) a barrel portion insertion section 54. The plate-shaped portion support section 53 is a circular dented region at the top surface of the switch action main section 51. The barrel portion insertion section 54 is a region in the shape of a circular hole that is located at a central portion of the plate-shaped portion support section 53 and that extends downward from the plate-shaped portion support section 53.

The housing main section 21*a* has, at the position of the barrel portion insertion section 54, four positioning recesses 55 in which the positioning protrusions 47 of the plunger 41 are fitted. The four positioning recesses 55 are located at the wall surface around the barrel portion insertion section 54 so as to be separated from one another by 90 degrees.

Thus, when the plunger 41 is mounted in the plunger mounting recess section 52 of the switch action main section 51, (i) the barrel portion 42 of the plunger 41 is inserted in the barrel portion insertion section 54 of the plunger mounting recess section 52, (ii) the positioning protrusions 47 of the plunger 41 are fitted in two of the positioning recesses 55 at the plunger mounting recess section 52, and (iii) the plate-shaped portion 43 of the plunger 41 is disposed on the plate-shaped portion support section 53 of the plunger mounting recess section 52. The plunger 41 may be mounted on the switch action main section 51 for disposition in any of the four orientations angled at 90 degrees to one another through a 90-degree rotation.

<First to Third Action Modes of Limit Switch 1>

The first and second cams 33 and 34 of the cam-containing block 12, the first to third cam support sections 44 to 46 and positioning protrusions 47 of the plunger 41, and the plunger mounting recess section 52 are so positionally related to one another as to allow the limit switch 1 to be set in any of a first action mode (first orientation) through a third action mode (third orientation) described below.

The first action mode (first orientation) is a mode in which the first and second cams 33 and 34 can each act on one of the first to third cam support sections 44 to 46. The first action mode is, in one or more embodiments of the present invention, a mode in which the first and second cams 33 and 34 can act respectively on the first and second cam support sections 44 and 45.

The second action mode (second orientation) is a mode in which only the first cam 33 can act on one of the first to third cam support sections 44 to 46. The second action mode is, in one or more embodiments of the present invention, a mode in which the first cam 33 can act on the third cam support section 46.

The third action mode (third orientation) is a mode in which only the second cam 34 can act on one of the first to third cam support sections 44 to 46. The third action mode is, in one or more embodiments of the present invention, a mode in which the second cam 34 can act on the third cam support section 46.

With the plunger 41 mounted in the plunger mounting recess section 52, the plate-shaped portion 43 of the plunger 41 projects from the top surface of the housing main section 21*a*. The above arrangements are not limiting, however. One or more embodiments of the present invention is arranged such that at least the first to third cam support sections 44 to 46 project from the top surface of the housing main section 21*a* of the switch action main section 51. In this state, the plunger 41 is being pushed upward by a spring (elastic member) 62 (see FIG. 5) inside the switch action main section 51, and the switch module 22 is off.

When the first cam 33 or the second cam 34 acts on any of the first to third cam support sections 44 to 46 of the plunger 41, the plunger 41 is pushed downward. In this state, the operation of the plunger 41 turns on the switch module 22.

<Operation of Limit Switch 1>

(Operation in First Action Mode)

Figure 7:
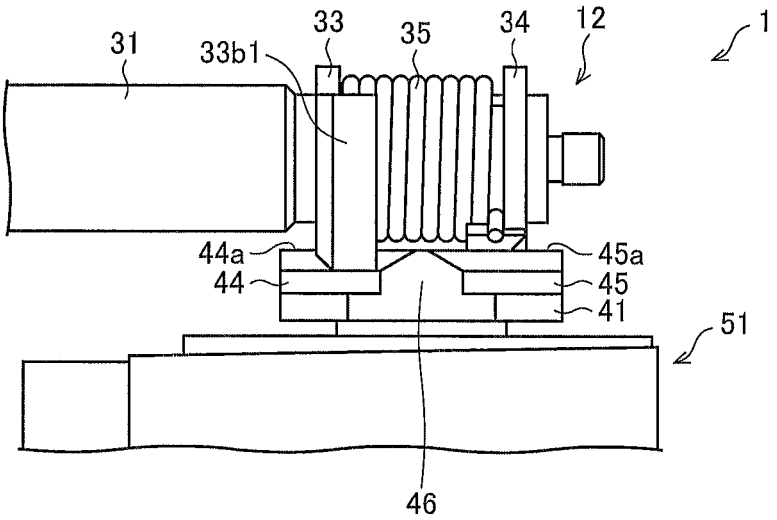
FIG. 7 is an elevational view of the limit switch of FIG. 1 set in a first action mode.
Figure 8:
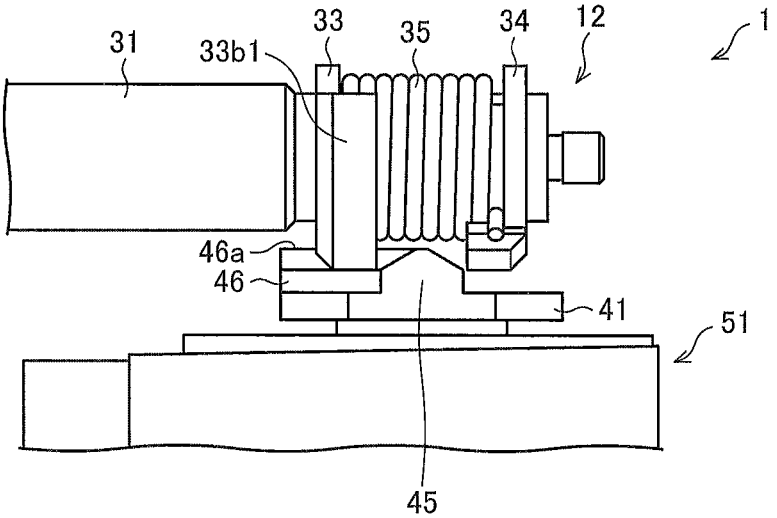
FIG. 8 is an elevational view of the limit switch of FIG. 1 set in a second action mode.
Figure 9:
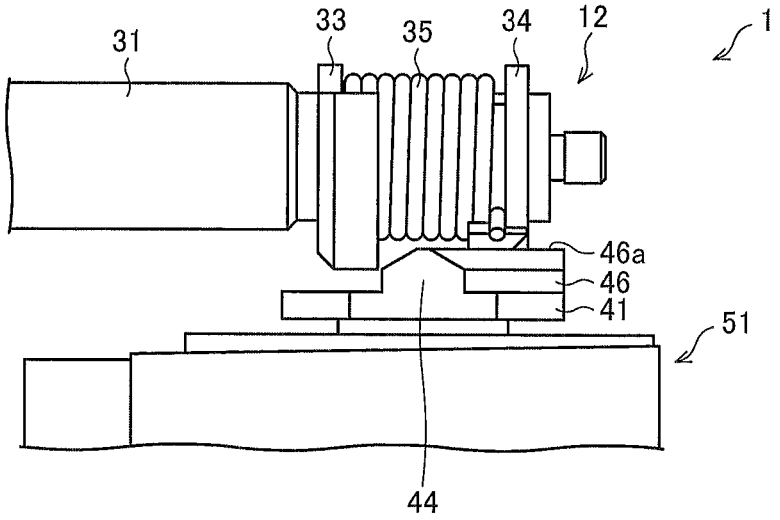
FIG. 9 is an elevational view of the limit switch of FIG. 1 set in a third action mode.

The description below deals with how the limit switch 1, which has the above arrangement, operates in the first to third action modes. FIG. 7 is an elevational view of the limit switch 1 set in the first action mode. FIG. 8 is an elevational view of the limit switch 1 set in the second action mode. FIG. 9 is an elevational view of the limit switch 1 set in the third action mode.

In the first action mode, as illustrated in FIG. 7, the first cam 33 can act on the first cam support section 44 of the plunger 41, while the second cam 34 can act on the second cam support section 45 of the plunger 41. When the rotary lever 13 has not been rotated (that is, in the upright position illustrated in FIG. 1), the first and second cams 33 and 34 are each located in a non-active position. When the first and second cams 33 and 34 are each in the non-active position, the depressions 33*b*21 and 34*b*21 are positioned to respectively meet the triangular projections 44*a* and 45*a* of the first and second cam support sections 44 and 45. Accordingly, the plunger 41 is pushed upward by the spring 62 inside the switch action main section 51, with the result of the plunger 41 projecting upward. The limit switch 1 is off in this state. The first and second cams 33 and 34 are each located in the non-active position when the rotary lever 13 has not been rotated in the second and third action modes as well.

In a case where the rotary lever 13 has been rotated clockwise by an external force to lose the upright position, that rotation drives the first cam 33 to rotate clockwise as well. The switch-on section 33*b*1 of the first cam 33 in turn acts on the first cam support section 44 to push down the plunger 41, turning on the limit switch 1. The second cam 34 is not rotated during this operation.

In a case where the rotary lever 13 has been rotated counterclockwise by an external force to lose the upright position, that rotation drives the second cam 34 to rotate counterclockwise as well. The switch-on section 34*b*1 of the second cam 34 in turn acts on the second cam support section 45 to push down the plunger 41, turning on the limit switch 1. The first cam 33 is not rotated during this operation.

Releasing the rotary lever 13 from the external force applied allows it to return to the upright position. In this case, (i) the plunger 41 is pushed up by the spring 62 inside the switch action main section 51, returning to the state of upward projection, and (ii) the first cam 33 is rotated counterclockwise by the force of the torsion spring 35, returning to the non-active position.

(Operation in Second Action Mode)

In the second action mode, as illustrated in FIG. 8, the first cam 33 can act on the third cam support section 46 of the plunger 41.

In a case where the rotary lever 13 has been rotated clockwise by an external force to lose the upright position, that rotation drives the first cam 33 to rotate clockwise as well. This pushes down the plunger 41, turning on the limit switch 1. The second cam 34 is not rotated during this operation.

In a case where the rotary lever 13 has been rotated counterclockwise by an external force to lose the upright position, that rotation drives the second cam 34 to rotate counterclockwise as well. However, since no cam support section of the plunger 41 is present under the second cam 34, the plunger 41 remains projecting, with the result of the limit switch 1 remaining off. The first cam 33 is not rotated during this operation.

(Operation in Third Action Mode)

In the third action mode, as illustrated in FIG. 9, the second cam 34 can act on the third cam support section 46 of the plunger 41.

In a case where the rotary lever 13 has been rotated clockwise by an external force to lose the upright position, that rotation drives the first cam 33 to rotate clockwise as well. However, since no cam support section of the plunger 41 is present under the first cam 33, the plunger 41 remains projecting, with the result of the limit switch 1 remaining off. The second cam 34 is not rotated during this operation.

In a case where the rotary lever 13 has been rotated counterclockwise by an external force to lose the upright position, that rotation drives the second cam 34 to rotate counterclockwise as well. This pushes down the plunger 41, turning on the limit switch 1. The first cam 33 is not rotated during this operation.

As described above, the limit switch 1 is arranged such that changing the orientation of the plunger 41 through a 90 degree rotation can set the limit switch 1 in any of the first action mode (in which the first and second cams 33 and 34 act on the plunger 41), the second action mode (in which only the first cam 33 acts on the plunger 41), and the third action mode (in which only the second cam 34 acts on the plunger 41). The limit switch 1 also allows the rotary lever 13 to rotate by 90 degrees (over-travel action).

With the above arrangement, the limit switch 1 is capable of being set in any of the first to third action modes in correspondence with the mode of use. The limit switch 1 is thus high in versatility and convenience.

The first and second cams 33 and 34 are each made of a metal material, whereas the plunger 41 is made of a resin material, which is softer than the first and second cams 33 and 34. This arrangement allows the limit switch 1 to have greater durability.

Specifically, if the material of the first and second cams 33 and 34 is similar in hardness to that of the plunger 41 (for example, similar kinds of metal material or resin material), the first and second cams 33 and 34 and the plunger 41 will wear out each other continuously as the limit switch 1 is used, likely decreasing the durability of the limit switch 1.

This is contrasted as follows with the arrangement in which the first and second cams 33 and 34 are each made of a metal material, and the plunger 41 is made of a resin material, which is softer than the first and second cams 33 and 34: At the start of the use of the limit switch 1, the first to third cam support sections 44 to 46 of the plunger 41 may be worn out easily. However, by the time the first to third cam support sections 44 to 46 of the plunger 41 have been worn out to an extent, the first and second cams 33 and 34 and the plunger 41 will fit ideally with each other on the abutting surface, making the plunger 41 unlikely to wear out thereafter. This allows the limit switch 1 to have greater durability.

Wear phenomena are roughly categorized into abrasive wear and adhesive wear. Abrasive wear is caused when a protrusion on a harder surface scrapes off a softer surface (that is, abrasive wear depends greatly on the surface roughness) or when a hard particle (foreign matter) present between sliding surfaces scrapes off those sliding surfaces.

Adhesive wear is caused when sliding surfaces of two members are partially transferred to each other, and is heavier when those surfaces are pressed against each other strongly (that is, adhesive wear depends on the surface pressure). In a case where the two surfaces are made of respective materials that are similar in composition to each other, adhesive wear tends to be severe wear (see below) as a result of transfer particles growing large. Further, adhesive wear is unlikely to occur in a case where the sliding surfaces are separated from each other by a substance that inhibits transfer (for example, an oil film). An abrasion loss is assumed by Holm's wear equation:

$$V=Z\cdot P\cdot l/pm,$$

where V represents the abrasion loss (wear volume), Z represents Holm's wear factor, P represents a load, l represents a wear distance, and pm represents the hardness of the softer surface.

Figure 10:
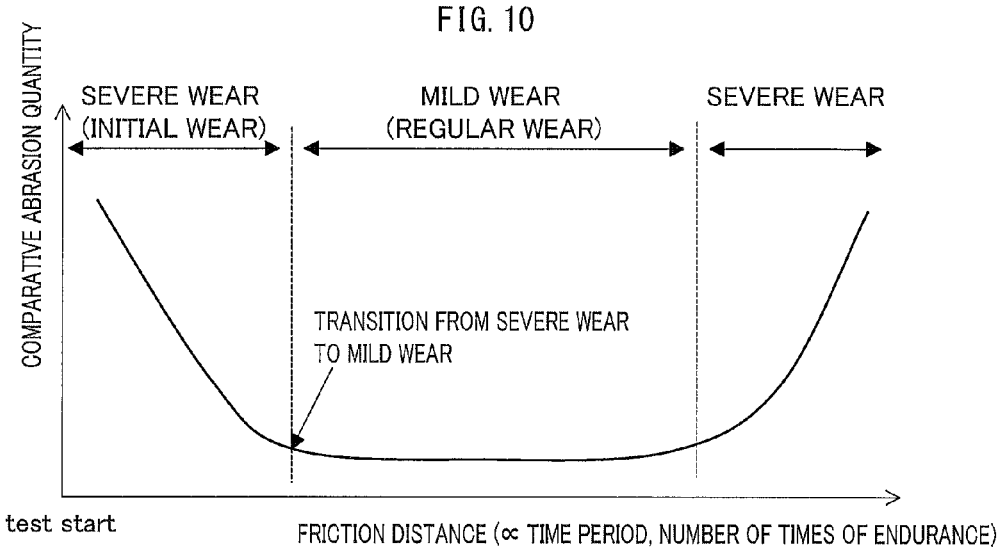
FIG. 10 is an explanatory graph illustrating how two contacting solids typically develop sliding wear.

Typically, sliding wear develops between two contacting solids as illustrated in FIG. 10. FIG. 10 is an explanatory graph illustrating transition between severe wear and mild wear. As illustrated in FIG. 10, wear develops along the time axis through a process including a period in which the wear is severe wear and a period in which the wear is mild wear. Severe wear generates large wear particles (several tens of micrometers or larger), and causes great attrition. Mild wear generates minute wear particles (submicron particles), and causes small attrition.

This indicates that in order to reduce attrition of sliding surfaces, it is important to (i) allow the wear to transition early from severe wear to mild wear and (ii) cause the wear to remain as mild wear for as long as possible to prevent it from transitioning to severe wear.

Figure 11:
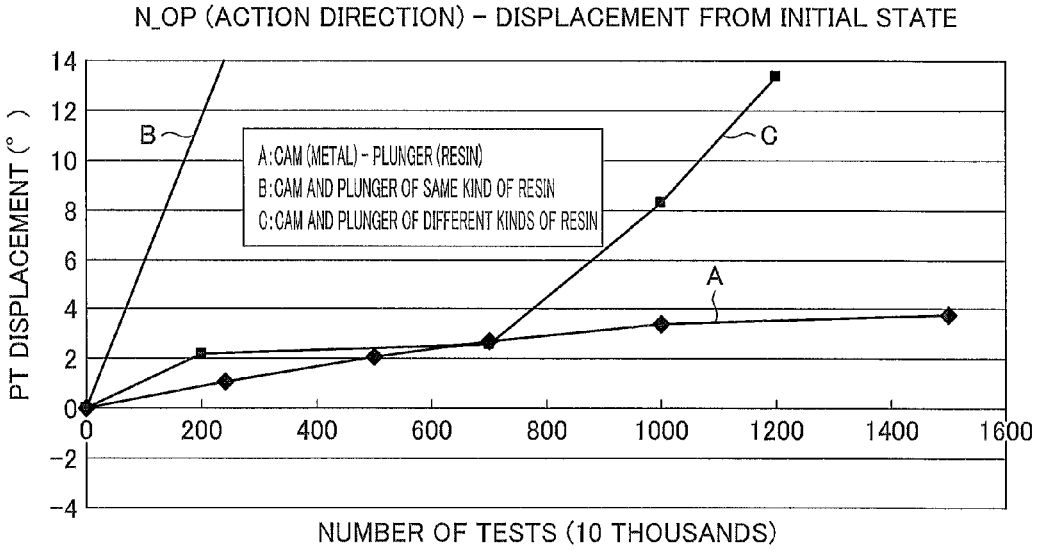
FIG. 11 is a graph illustrating the results of tests of wear resistance for the limit switch of FIG. 1 for a plurality of combinations of a material for the plunger and a material for first and second cams.

Thus, selecting an optimum combination of a material for the plunger 41 and a material for the first and second cams 33 and 34 can reduce sliding wear to reduce a characteristics change. FIG. 11 is a graph illustrating the results of tests of wear resistance for a plurality of combinations of a material for the plunger 41 and a material for the first and second cams 33 and 34. FIG. 11 shows, along the vertical axis labeled "PT DISPLACEMENT [°]", a change in the characteristics of the limit switch 1 which change is caused as a result of the first and second cams 33 and 34 and the plunger 41 having worn out each other. Specifically, the vertical axis indicates the amount of displacement, from the initial state, of the angle of the actuator (rotary lever 13) at which angle the limit switch 1 is turned on.

The line A indicates a case in which the first and second cams 33 and 34 are each made of a metal (sintered metal [SMF5040]) and the plunger 41 is made of a resin (PA66 [glass filler 30%]), which is softer than the first and second cams 33 and 34. The line A shows that this combination makes it possible to reduce sliding wear to reduce the change in characteristics of the limit switch 1.

The line B indicates a case in which the first and second cams 33 and 34 and the plunger 41 are made of the same kind of resin (PA66 [glass filler 30%]). The line B shows that this combination unfortunately lets adhesive wear develop rapidly to cause drastic attrition.

The line C indicates a case in which the first and second cams 33 and 34 and the plunger 41 are made of different kinds of resin (namely, the first and second cams 33 and 34 are made of POM [M90-44]), whereas the plunger 41 is made of PA66 (glass filler 30%). The line C shows that this combination fails to prevent sliding wear. This is presumably because a great influence of frictional heat lowers the limit PV value (see below).

As is clear from the results illustrated in FIG. 11, in the case where the first and second cams 33 and 34 are each made of a metal material, and the plunger 41 is made of a resin material (which is softer than the first and second cams 33 and 34) to intentionally cause a difference in hardness between the two materials, it is possible to reduce adhesive wear and allow the wear of the plunger 41 to transition early to mild wear. This in turn allows the limit switch 1 to have greater durability.

The plunger 41 needs to have hardness (limit PV value) that prevents the plunger 41 from being deformed by a surface pressure in operation. Further, applying a highly viscous grease to the plunger 41 to prevent that oil film from being broken can prevent wear of the plunger 41 from easily transitioning from mild wear to severe wear. In addition, according to one or more embodiments of the present invention, the plunger 41 contains an optimum amount of glass filler. If the plunger 41 contains an excessively large amount of glass filler, the plunger 41 will leave abrasion powder containing the glass filler, which will in turn cause abrasive wear. If the plunger 41 contains an excessively small amount of glass filler, the plunger 41 will have a low limit PV value, so that it will fail to endure the surface pressure and be deformed as a result.

The plunger 41 is lighter in weight in the case where it is made of resin. This arrangement allows the limit switch 1 to have improved vibration resistance and improved impact resistance. The above arrangement can consequently prevent such defects as (i) a defect where a vibration causes the limit switch 1 to malfunction since the plunger 41, which slides in the up-and-down direction, has a large weight and (ii) a defect where an impact or the like on the limit switch 1 upon a drop damages an internal microswitch.

The first and second cams 33 and 34 are each not necessarily made of a metal material in its entirety: The first and second cams 33 and 34 may alternatively be arranged such that at least the respective surfaces of the cam action sections 33*b* and 34*b* are each made of a metal material. Similarly, the plunger 41 is not necessarily made of a resin material in its entirety: The plunger 41 may alternatively be arranged such that at least the first to third cam support sections 44 to 46 are each made of a resin material.

EXAMPLE 1

To produce a limit switch 1, first and second cams 33 and 34 were each formed of SMF5040, and a plunger 41 was formed of nylon PA66 containing a glass filler. A test of mechanical durability was conducted for that limit switch 1. As the result of the test, the limit switch 1 was able to operate stably even for over 15 million operations. This shows that the limit switch 1 of the present Example had durability greatly improved over that of conventional counterparts.

EXAMPLE 2

To produce a limit switch 1, first and second cams 33 and 34 were each formed of SMF5040, and a plunger 41 was formed of PEEK. PEEK is known as a material superior in resistance to heat and sliding. A test of mechanical durability was conduct for that limit switch 1. As the result of the test, the limit switch 1 was able to operate stably even for over 30 million operations at normal temperatures and over 1 million operations at a high temperature of 120° C. This shows that the limit switch 1 of the present Example had durability greatly improved over that of conventional counterparts.

One or more embodiments of the present invention provides a switch including: a rotary shaft adapted to rotate in response to an external force; a cam provided on the rotary shaft and including a cam action section, the cam being adapted to rotate in response to the rotation of the rotary shaft; a displacement member including a cam support section adapted to contact the cam action section, the displacement member being adapted to be displaced in response to the cam support section being pressed by the cam action section rotating; and a switch module for performing an on-off action in response to the displacement of the displacement member, the cam action section being made of a metal, the cam support section being made of a resin softer than the cam action section.

With the above arrangement, in a case where the rotary shaft has been rotated by an external force, the cam is rotated in response to the rotation of the rotary shaft. The cam action section of the cam then presses the cam support section of the displacement member to displace the displacement member. This displacement of the displacement member drives the switch module to perform an on-off action.

If, for instance, the cam action section of the cam and the cam support section of the displacement member are each made of a hard material such as a metal, the cam action section and the cam support section will wear out each other continuously as the switch is used, likely decreasing the durability of the switch.

This is contrasted with the switch according to one or more embodiments of the present invention, in which the cam action section is made of a metal, whereas the cam support section of the displacement member is made of a resin softer than the cam action section of the cam. With this arrangement, at the start of the use of the switch, the cam support section of the displacement member may be worn out easily. However, by the time the cam support section of the displacement member has been worn out to an extent, the cam action section and the cam support section will fit ideally with each other on the abutting surface, making the cam support section of the displacement member unlikely to wear out thereafter. This allows the switch to have greater durability and higher reliability.

The switch may be arranged such that the cam includes: a first cam adapted to rotate in a first direction in response to a rotation of the rotary shaft in the first direction; and a second cam adapted to rotate in a second direction opposite to the first direction in response to a rotation of the rotary shaft in the second direction, the cam support section of the displacement member includes a first cam support section, a second cam support section, and a third cam support section, and the displacement member is capable of being disposed in any of (i) a first orientation in which the cam action section of the first cam acts on the first cam support section, and the cam action section of the second cam acts on the second cam support section, (ii) a second orientation in which the cam action section of the first cam acts on the third cam support section, and the cam action section of the second cam acts on none of the cam support sections, and (iii) a third orientation in which the cam action section of the first cam acts on none of the cam support sections, and the cam action section of the second cam acts on the third cam support section.

A switch according to one or more embodiments of the present invention is a switch including: a rotary shaft adapted to rotate in response to an external force; a cam provided on the rotary shaft and including a cam action section, the cam being adapted to rotate in response to the rotation of the rotary shaft; a displacement member including a cam support section adapted to contact the cam action section, the displacement member being adapted to be displaced in response to the cam support section being pressed by the cam action section rotating; and a switch module for performing an on-off action in response to the displacement of the displacement member, the cam including: a first cam adapted to rotate in a first direction in response to a rotation of the rotary shaft in the first direction; and a second cam adapted to rotate in a second direction opposite to the first direction in response to a rotation of the rotary shaft in the second direction, the cam support section of the displacement member including a first cam support section, a second cam support section, and a third cam support section, the displacement member being capable of being disposed in any of (i) a first orientation in which the cam action section of the first cam acts on the first cam support section, and the cam action section of the second cam acts on the second cam support section, (ii) a second orientation in which the cam action section of the first cam acts on the third cam support section, and the cam action section of the second cam acts on none of the cam support sections, and (iii) a third orientation in which the cam action section of the first cam acts on none of the cam support sections, and the cam action section of the second cam acts on the third cam support section.

With the above arrangement, the displacement member may be disposed in any of (i) the first orientation, in which the cam action section of the first cam acts on the first cam support section, and the cam action section of the second cam acts on the second cam support section, (ii) the second orientation, in which the cam action section of the first cam acts on the third cam support section, and the cam action section of the second cam acts on none of the cam support sections, and (iii) the third orientation, in which the cam action section of the first cam acts on none of the cam support sections, and the cam action section of the second cam acts on the third cam support section.

The switch according to one or more embodiments of the present invention is thus arranged such that the displacement member is capable of being disposed in any of the first to third orientations in correspondence with the mode of use. The switch according to one or more embodiments of the present invention is therefore high in versatility and convenience.

The switch may further include: an elastic member for, after the displacement member has been displaced, moving the displacement member back to a position at which the displacement member was present before the displacement, wherein: the displacement member is displaced in an up-and-down direction; the displacement member is disposed under the cam; and the displacement member is displaced downward in response to the cam support section being pressed by the cam action section rotating.

With the above arrangement, the displacement member is displaced downward in response to the cam support section being pressed by the cam action section rotating, and is moved back through the action of the elastic member to the position at which it was present before the displacement. The elastic force of the elastic member is thus the only load that is imposed on the cam and the displacement member when the displacement member returns to the position at which it was present before the displacement. The above arrangement can therefore reduce the load imposed on the cam and the displacement member when the displacement member returns to the position at which it was present before the displacement, and allows the switch to have even greater durability.

The switch may further include: a torsion spring disposed between the first cam and the second cam for, when the rotary shaft has been released from the external force, returning the first cam and the second cam to respective positions at which the first cam and the second cam were present before the respective rotations.

With the above arrangement, when the rotary shaft has been released from the external force, the first cam and the second cam are returned, through the action of the torsion spring disposed between the first cam and the second cam, to the respective positions at which they were present before the respective rotations.

The above simple arrangement makes it possible to reduce the load imposed on the first cam and the second cam when they return to the respective positions at which they were present before the respective rotations, and allows the switch to have even greater durability.

The present invention is not limited by the description of the embodiments above, and may be altered in various manners within the scope of the claims. Any embodiments based on a proper combination of technical means disclosed in the embodiments are also encompassed in the technical scope of the present invention.

One or more embodiments of the present invention is applicable to a limit switch for use on a production line, for example.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

REFERENCE SIGNS LIST

1 limit switch (switch)
11 switch action section
12 cam-containing block
13 rotary lever
21 action section housing
22 switch module
31 rotary shaft
32 block housing
33 first cam
33*b* cam action section
34 second cam
34*b* cam action section
33*b*1 switch-on section
34*b*1 switch-on section
33*b*2 switch-off section
34*b*2 switch-off section
33*b*21 depression
34*b*21 depression
35 torsion spring
41 plunger
42 barrel portion
43 plate-shaped portion
44 first cam support section
44*a* triangular projection
45 second cam support section
45*a* triangular projection
46 third cam support section
46*a* triangular projection
61 rotation limiting member
62 spring (elastic member)

The invention claimed is:

1. A switch comprising:

a rotary shaft adapted to rotate in response to an external force;

a cam provided on the rotary shaft and including a cam action section, the cam being adapted to rotate in response to the rotation of the rotary shaft;

a displacement member including a cam support section adapted to contact the cam action section, the displacement member being adapted to be displaced in response to the cam support section being pressed by the cam action section rotating; and a switch module for performing an on-off action in response to the displacement of the displacement member, wherein the cam action section is made of a sintered metal, wherein the cam support section is made of nylon containing a glass filler, wherein the nylon containing the glass filler is a resin softer than the cam action section, and wherein an amount of the glass filler is adjusted to fall within a range where (i) abrasion powder containing the glass filler does not cause abrasive wear on the cam support section, and (ii) the cam support section does not become deformed by a surface pressure during operation.

2. The switch according to claim 1, further comprising an elastic member for, after the displacement member has been displaced, moving the displacement member back to a position at which the displacement member was present before the displacement, wherein:

the displacement member is displaced in an up-and-down direction;

the displacement member is disposed under the cam; and the displacement member is displaced downward in response to the cam support section being pressed by the cam action section rotating.

3. A switch comprising:

a rotary shaft adapted to rotate in response to an external force;

a cam provided on the rotary shaft and including a cam action section, the cam being adapted to rotate in response to the rotation of the rotary shaft;

a displacement member including a cam support section adapted to contact the cam action section, the displacement member being adapted to be displaced in response to the cam support section being pressed by the cam action section rotating; and a switch module for performing an on-off action in response to the displacement of the displacement member, wherein the cam comprises:

a first cam adapted to rotate in a first direction in response to a rotation of the rotary shaft in the first direction; and a second cam adapted to rotate in a second direction opposite to the first direction in response to a rotation of the rotary shaft in the second direction, wherein the cam support section of the displacement member comprises a first cam support section, a second cam support section, and a third cam support section, wherein the displacement member is capable of being disposed in any of (i) a first orientation in which the cam action section of the first cam acts on the first cam support section, and the cam action section of the second cam acts on the second cam support section, (ii) a second orientation in which the cam action section of the first cam acts on the third cam support section, and the cam action section of the second cam acts on none of the cam support sections, and (iii) a third orientation in which the cam action section of the first can acts on none of the cam support sections, and the cam action section of the second cam acts on the third cam support section, wherein the cam action section is made of a sintered metal, wherein the cam support section is made of nylon containing a glass filler, wherein the nylon containing the glass filler is a resin softer than the cam action section, and wherein an amount of the glass filler is adjusted to fall within a range where (i) abrasion powder containing the glass filler does not cause abrasive wear on the cam support section, and (ii) the cam support section does not become deformed by a surface pressure during operation.

4. The switch according to claim 3, further comprising an elastic member for, after the displacement member has been displaced, moving the displacement member back to a position at which the displacement member was present before the displacement, wherein:

the displacement member is displaced in an up-and-down direction;

the displacement member is disposed under the cam; and the displacement member is displaced downward in response to the cam support section being pressed by the cam action section rotating.

5. The switch according to claim 3, further comprising a torsion spring disposed between the first cam and the second cam for, when the rotary shaft has been released from the external force, returning the first cam and the second can to respective positions at which the first cam and the second cam were present before the respective rotations.

* * * * *